United States Patent [19]

Lorenz et al.

[11] Patent Number: 4,508,255

[45] Date of Patent: Apr. 2, 1985

[54] APPARATUS FOR MANUFACTURING WHEEL RIM BLANKS

[75] Inventors: Horst Lorenz, Solingen; Richard Schulte, Wuppertal, both of Fed. Rep. of Germany

[73] Assignee: Th. Kieserling & Albrecht, Solingen, Fed. Rep. of Germany

[21] Appl. No.: 342,327

[22] PCT Filed: Oct. 3, 1981

[86] PCT No.: PCT/DE81/00166

§ 371 Date: Jan. 25, 1982

§ 102(e) Date: Jan. 25, 1982

[87] PCT Pub. No.: WO82/01142

PCT Pub. Date: Apr. 15, 1982

[30] Foreign Application Priority Data

Oct. 4, 1980 [DE] Fed. Rep. of Germany ..... 3037614

[51] Int. Cl.[3] ..... B23K 5/22

[52] U.S. Cl. ..... 228/5.1; 228/17.5; 228/19; 228/47

[58] Field of Search ..... 228/19, 145, 146, 5.1, 228/17.5, 47, 125, 152; 219/64; 198/342, 680; 29/791, 33 A, 33 B, 156.1; 269/43, 289 MR

[56] References Cited

U.S. PATENT DOCUMENTS

| | | | |
|---|---|---|---|
| Re. 20,439 | 7/1937 | Rippel | 29/33 A |
| 1,215,773 | 2/1917 | Butcher | 29/33 A |
| 1,768,493 | 6/1930 | Roddy | 198/680 |
| 1,808,261 | 6/1931 | Sessions | 219/64 |
| 1,884,467 | 10/1932 | Windsor | 228/19 |
| 1,954,511 | 4/1934 | Adams | 29/33 A |
| 2,716,479 | 8/1955 | Coder et al. | 198/680 |
| 3,349,212 | 10/1967 | Morris et al. | 228/19 |
| 3,662,941 | 5/1972 | Gage | 228/19 |
| 3,729,124 | 4/1973 | Kedzior et al. | 228/19 |
| 3,759,140 | 9/1973 | Connelly | 228/19 |
| 3,797,088 | 3/1974 | Stettler et al. | 29/159.1 |
| 3,862,563 | 1/1975 | Fencl et al. | 29/159.1 |
| 3,885,825 | 5/1975 | Amberg et al. | 198/680 |
| 3,894,630 | 7/1975 | Shank | 198/680 |
| 4,082,935 | 4/1978 | Lampietti et al. | 228/17.5 |

FOREIGN PATENT DOCUMENTS 7324797 5/1974 France .

*Primary Examiner*—Nicholas P. Godici
*Assistant Examiner*—M. Jordan
*Attorney, Agent, or Firm*—Fay & Sharpe

[57] ABSTRACT

Apparatus for manufacturing wheel rim blanks from flat metal strip includes a plurality of work stations through which the metal strip passes to produce a cylindrical ring having a longitudinal axis and a welded joint. The work stations include a strip feed station, a cylinder forming station, a joint orientation station, a joint welding station and finishing stations. The work stations are arranged in a generally Z-shaped configuration with end legs extending in opposite directions from opposite ends of a transverse connecting leg. The strip feed station is located along one end leg, while the finishing stations are arranged along the other end leg. The ring forming, joint orientation and joint welding stations are aligned in succession along the connecting leg. The ring members are received in upwardly open U-shaped supports at the finishing stations and are moved in arcuate paths from the welding station through the finishing stations by an overhead conveyor device.

12 Claims, 4 Drawing Figures

1
14
60
46
17
4
16
58
15
30
5
18
3
2
31
6
19
70

APPARATUS FOR MANUFACTURING WHEEL RIM BLANKS

BACKGROUND OF THE INVENTION

This application relates to the art of wheel rim blanks and, more particularly, to apparatus for manufacturing wheel rim blanks. Although the apparatus of the present application is particularly suitable for manufacturing wheel rim blanks and will be described with specific reference thereto, it will be appreciated that the invention has broader aspects and can be used for manufacturing other ring members.

Apparatus of a known type for manufacturing wheel rim blanks is disclosed in U.S. Pat. No. 3,934,324 issued Jan. 27, 1976, to Hess et al. In the Hess apparatus, a flat metal strip is formed into a cylindrical ring and is then moved axially along an elongated horn or mandrel through the necessary work stations, and is then rolled diagonally downwardly for finishing. In an arrangement of this type, it is not possible to remove a ring at any given station in the event of a malfunction and it is necessary to move the ring through all of the work stations or cut the ring in half for separation from the mandrel. Inspection of the rings and each individual work station is also difficult because all of the work stations are aligned along the mandrel. In the arrangement of Hess, the conveyor devices for moving the rings are located between individual work stations below the rings and these conveyor devices must be protected against chips or the like produced during the finishing operations. Accessibility to the tools in the Hess apparatus is also difficult and, in deburring the joint, it is necessary to absorb axial forces of axially movable clamping devices.

It would be desirable to have an apparatus for manufacturing wheel rim blanks in a simplified manner arranged so that access may be had to each work station, and with improved supports and conveying arrangements.

SUMMARY OF THE INVENTION

Flat metal strips are formed into cylindrical rings having longitudinal axes and opposed ends welded together at a joint. Apparatus for manufacturing the rings comprises a plurality of work stations including a strip feed station, a ring forming station, a joint orientation station, a welding station for welding the joint and finishing stations for finishing the joint. The ring forming, joint orientation and welding stations are arranged in direct succession for processing a ring moving generally along its longitudinal axis through a work path. The strip feed station is positioned for feeding the metal strip to the ring forming station in a direction transverse to the work path. The finishing stations are positioned for receiving rings moving thereto from the welding station in a direction transversely of the work path.

In a preferred arrangement, the work stations in plan view are arranged in a generally Z-shaped configuration which includes end legs extending in opposite directions from opposite ends of a transverse connecting leg. The strip feed station is positioned along one of the end legs and the finishing stations are positioned along the other end leg. The ring forming, joint orientation and welding stations are positioned along the connecting leg. This arrangement provides easy access to each work station and the tools thereat.

In the arrangement of the present application, the rings are not conducted along a mandrel so it is easy to remove a ring from any given work station if so desired and inspection of the operations at each work station is also facilitated.

Transfer means for transferring the rings between at least certain of the stations is operative to move the rings in an arcuate path between adjacent ones of such stations. The rings move laterally upwardly and then laterally downwardly through the arcuate path. In one arrangement, the transfer means includes gripper means for gripping the upper portion of the rings.

Each ring member has a predetermined width parallel to its longitudinal axis and the finishing stations have upwardly opening generally U-shaped ring supports of a width approximately the same as the predetermined width of each ring. At the finishing stations, each ring is positioned with its axis extending horizontally and with its joint at the lowermost point of the ring. Finishing tools move generally parallel to the ring longitudinal axis for finishing the joint and the U-shaped ring supports are positioned on opposite sides of each finishing tool for supporting the ring on opposite sides of the ring joint during finishing operations.

A finishing station includes a tool slide moveable generally parallel to the ring longitudinal axis and carries finishing tools for finishing the welded joint. The slide includes guide rolls engageable with inner and outer surfaces of the ring member on opposite sides of the ring joint. The upwardly open generally U-shaped ring member supports are located on opposite sides of the slide closely adjacent thereto.

It is a principal object of the present invention to provide an improved apparatus for manufacturing wheel rim blanks or other cylindrical ring members.

It is an additional object of the invention to provide such an apparatus wherein easy access is possible to each work station and a ring member located at each station.

It is a further object of the invention to provide such an apparatus wherein a ring member can be removed from a work station without moving same through the entire apparatus and without cutting same in half.

It is another object of the invention to provide such an apparatus having an improved support arrangement for the ring members at the finishing stations.

It is also an object of the invention to provide an improved arrangement for transferring the ring members between certain of the work stations.

It is a further object of the invention to provide such an apparatus having an improved tool slide and ring member support arrangement at the finishing stations.

DESCRIPTION OF A PREFERRED EMBODIMENT

Figure 1:
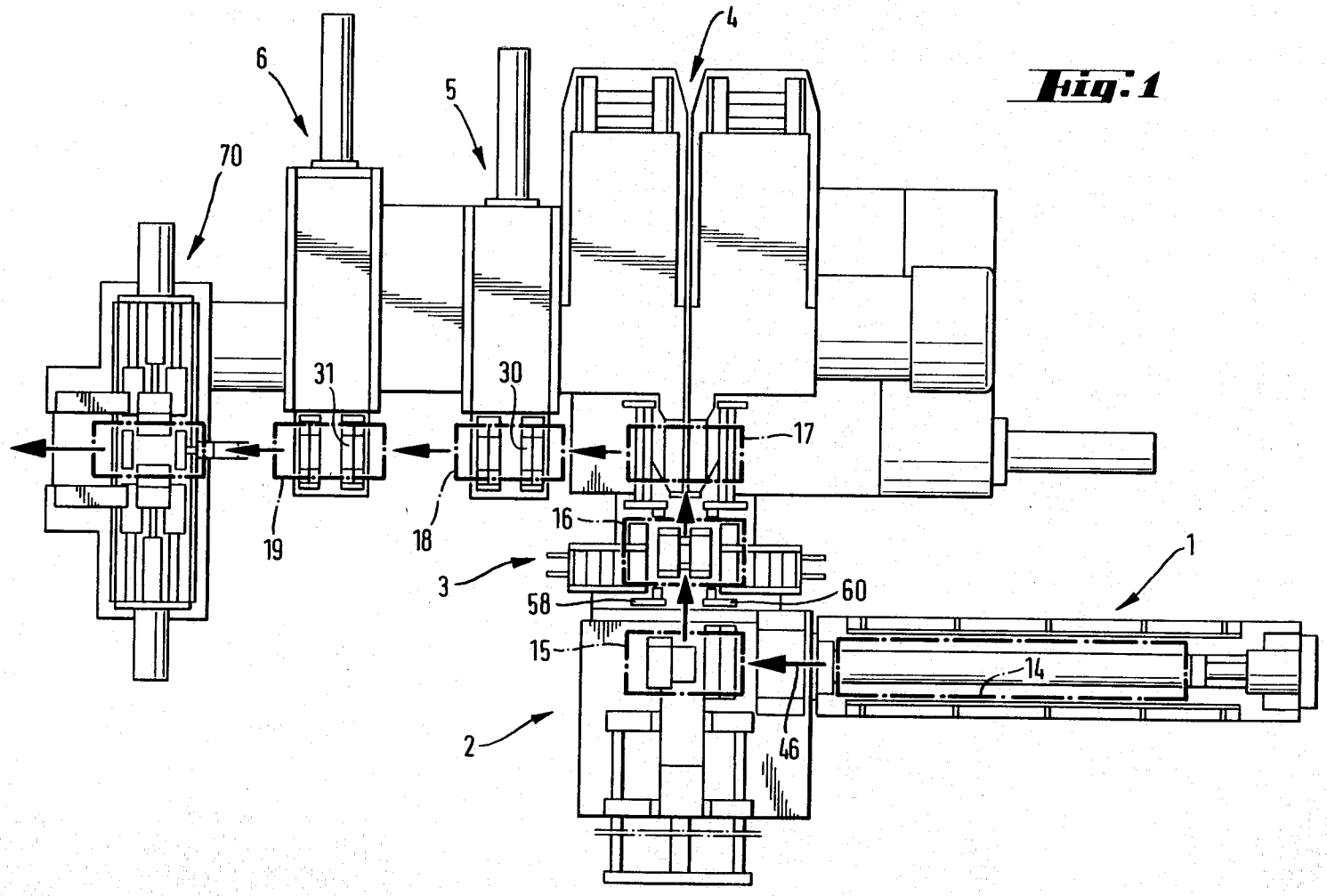
FIG. 1 is a top plan view of an apparatus constructed in accordance with the present application.

With reference to the drawing, wherein the showings are for purposes of illustrating a preferred embodiment of the invention only and not for purposes of limiting same, FIG. 1 shows an apparatus for manufacturing wheel rim blanks 15, 16, 17, 18 and 19 which will be generally referred to as cylindrical rings or ring members. As shown in the top plan view of FIG. 1, the apparatus is arranged in a generally Z-shaped configuration having parallel end legs extending in opposite directions from opposite ends of a perpendicular connecting leg. A strip feed station 1 for feeding flat metal strip is located along one end leg. A cylinder forming station 2, a joint orientation station 3 and a welding station 4 are aligned in succession along the connecting leg. A plurality of finishing stations are arranged along the other end leg and include a longitudinal joint deburring station 5, a joint smoothing station 6 and a transverse joint deburring station 70. It will be understood that a machine for performing the necessary work is located at each work station.

Figures 2, 3:
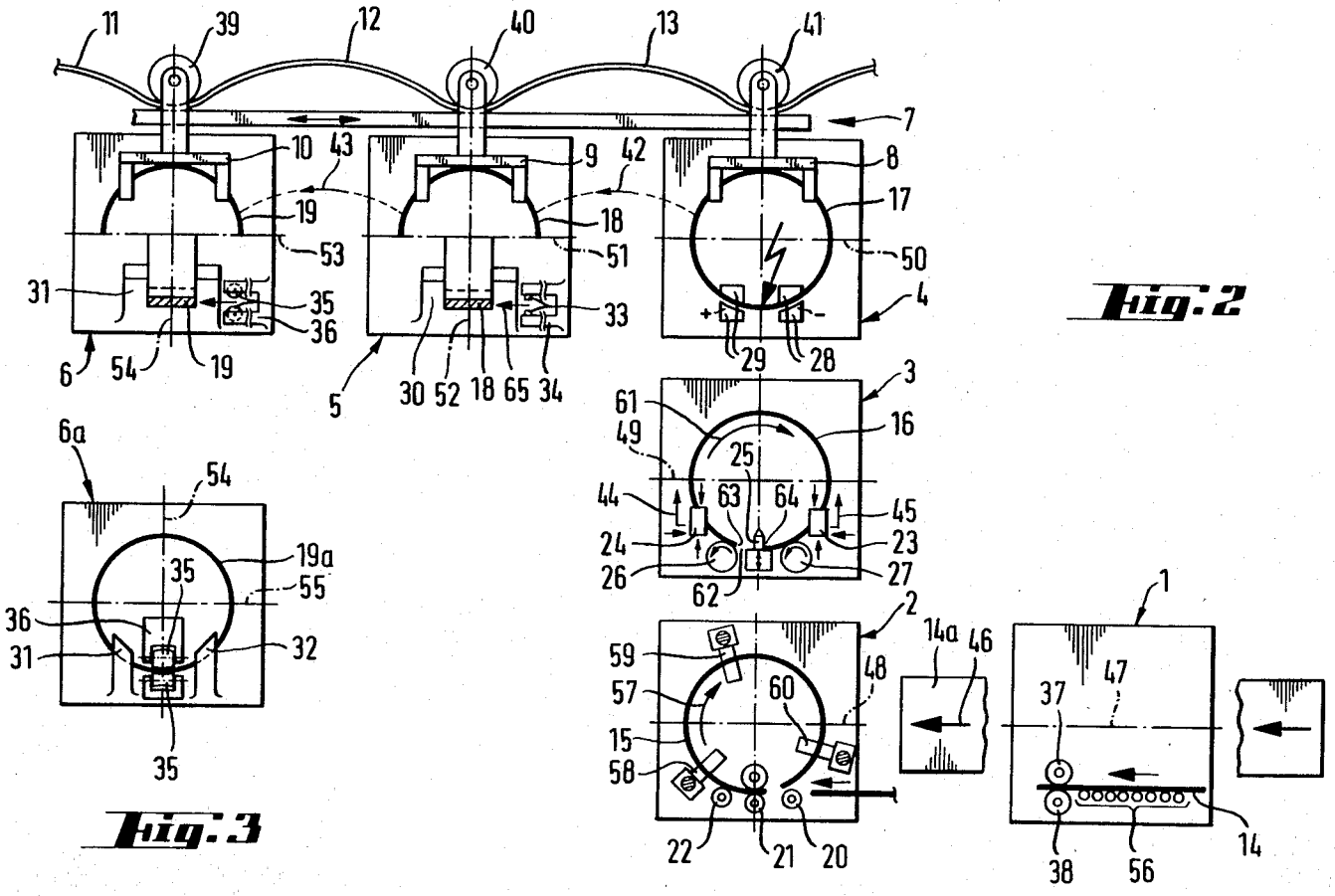
FIG. 2 is a top plan view similar to FIG. 1 and with each work station laid down or rotated 90° in the plane of the paper so as to appear in side elevation.
FIG. 3 is a side elevational view of a finishing station.

In FIG. 2, the work stations are still arranged in the generally Z-shaped configuration as if view from above but each work station is laid down or rotated 90° in the plane of the paper so that each station appears as if it is in side elevation. The axes about which each work station in FIG. 2 is rotated 90° are generally indicated by numerals 47, 48, 49, 50, 51 and 53. With respect to the longitudinal joint deburring station 5 and the joint smoothing station 6, the lower half of each station is rotated 90° around an axis 52, 54 so that the lower half of each station below axes 51, 53 appears as an end elevation. In FIG. 3, the finishing station 6*a* appears as if rotated to side elevation about axis 55, while the lower half is rotated about axis 54 to appear in end elevation.

With reference to FIG. 2, a flat metal strip 14, 14*a* is moved longitudinally in the direction of arrow 46 by driven rollers 37, 38 over support rollers 56 to the cylinder forming station 2. At the cylinder forming station 2, the flat metal strip 14, 14*a* is formed by rollers 20, 21 and 22 into a cylindrical ring 15. The flat metal strip is moved in a circular path as indicated by arrow 57 as it is formed into a cylindrical ring. At this stage of manufacture, the opposite ends of the ring are still spaced from one another across a gap where the longitudinal joint is to be formed. A plurality of longitudinally movable pusher devices 58, 59 and 60 define transfer means for transferring the ring 15 in the direction of its longitudinal axis from the ring forming station 2 to the joint orientation station 3.

At the joint orientation station 3, the gap 62 between opposite ends 63, 64 of the ring 16 must be oriented so that it is located in the desired position for welding at the welding station. Rollers 26, 27 at the joint orientation station 3 support the ring 16 and rotate same in the direction of arrow 61 until an axially movable pin 25 moves upwardly into the gap 62 and the ring end 64 bears against the pin. Thereafter, a pair of clamping jaws 23, 24 grip the ring 16 on opposite sides of the gap 62. The front ring end 64 is held stationary by the jaws 23, while the clamping jaws 24 move laterally for closing the gap 62 and bringing the ring ends 63, 64 together after retraction of the axially movable pin 25.

The clamping jaws 23, 24 hold the opposite ends 63, 64 of the ring 16 together where the joint is to be formed and such jaws also move parallel to the longitudinal axis of the ring 16 as generally indicated by arrows 44, 45 for transferring the ring 16 in the direction of its longitudinal axis from the joint orientation station 3 to the welding station 4. During transfer of the ring between the cylinder forming, joint orientation and welding stations, the longitudinal axis of the ring is located substantially horizontally and the ring is moved generally along its longitudinal axis by the pusher devices 58, 59 and 60, or by the clamping jaws 23, 24. The cylinder forming station 2 defines the entrance end of the connecting leg in the generally Z-shaped configuration, while the welding station 4 defines the exit station for the connecting leg.

At the welding station 4, the ring 17 is gripped by pairs of clamping jaws 28, 29 after which the jaws 23, 24 are released and returned to their original positions at the joint orientation station 3. The ends 63, 64 of the ring 17 are welded together at the welding station 4 in a known manner, and the clamping jaws 28, 29 are then opened and moved parallel to the longitudinal axis of the ring 17 to a position clear of the ring. Simultaneously with opening of the jaws 28, 29, an overhead gripper means 8 grips the upper portion of the ring 17 for carrying same in an arcuate path generally indicated by arrow 42 into the longitudinal joint deburring station 5. The transfer means for transferring the rings from the welding station 4 to the finishing stations and between the finishing stations is generally indicated by numeral 7 in FIG. 2, and includes upwardly arched guides 11, 12 and 13 on which rollers 39, 40 and 41 are movably supported. Each roller carries a gripper means 8, 9 and 10. The transfer means 7 reciprocates back and forth for gripping, transferring and releasing the rings. The welded joint is located at the lowermost position of the ring at each finishing station.

At the finishing station defined by the longitudinal joint deburring station 5 and in the joint smoothing station 6, 6*a*, the ring 18, 19, 19*a* is received in upwardly opening U-shaped supports 30, 31 and 32. The width of the upwardly open U-shaped supports is approximately the same as the predetermined width of each ring parallel to its longitudinal axis. In the longitudinal joint deburring station 5, the ring is supported in two U-shaped supports, only one of which is shown at 30 in the lower half of the finishing station 5 shown in FIG. 2. However, it will be recognized that at the longitudinal joint deburring station 5, there are two upwardly open U-shaped supports corresponding to the supports indicated at 31, 32 in FIG. 3 for the joint smoothing station 6*a*.

At the longitudinal joint deburring station 5, the jaw-like forward portion of the knife tool slide 34 is guided during movement indicated by arrow 65 with its tool knives 33 operating on both sides of the ring joint for deburring same. After the tool slide 34 is moved back away from the ring 18, the ring can be lifted upwardly and/or diagonally upwardly from the U-shaped supports.

In the event of a malfunction or the like, transfer means 7 can be moved away from the finishing stations and a defective workpiece can be removed from a station without affecting the workpieces in adjacent stations. The defective workpiece can also be removed without destruction of same.

At the end of the work stroke for the tool slide 34, the upper portion of the ring 18 is gripped by the gripper means 9 and moves in an arcuate path indicated by numeral 43 to the joint smoothing station 6. A slide 36 has a jaw-like tool holder with smoothing rollers 35 which roll away the residual burr on the joint so that the cross-sectional size and shape of the joint is the same as any other circumferential portion of the ring. The ring 19*a* in FIG. 3 is supported from below by the upwardly open U-shaped supports 31, 32 on opposite sides of the joint, and on opposite sides of the tool slide 36 and closely adjacent thereto. It will be recognized that corresponding supports are provided at station 6 for the ring 19.

The ring 19 is transferred from the joint smoothing station 6 by the gripper means 10 to the transverse joint deburring station 70 which is shown only in FIG. 1. At all of the finishing stations, the finishing tools and slides are located on one side of the ring and away from the ring supports so that the tools are easily accessible, and can be easily changed or repaired.

Transfer of the welded rings 17, 18 and 19 on smoothly curved arcuate paths is particularly advantageous because high acceleration is possible and this reduces the transfer time between adjacent stations. In addition, this arcuate movement of the rings is particularly suitable for the upwardly open U-shaped supports located on opposite sides of the ring joint. Close reception of each ring in the supports 30, 31 and 32 on opposite sides of the joint eliminates any time consuming power operated clamping operation so that finishing operations are not delayed.

Figure 4:
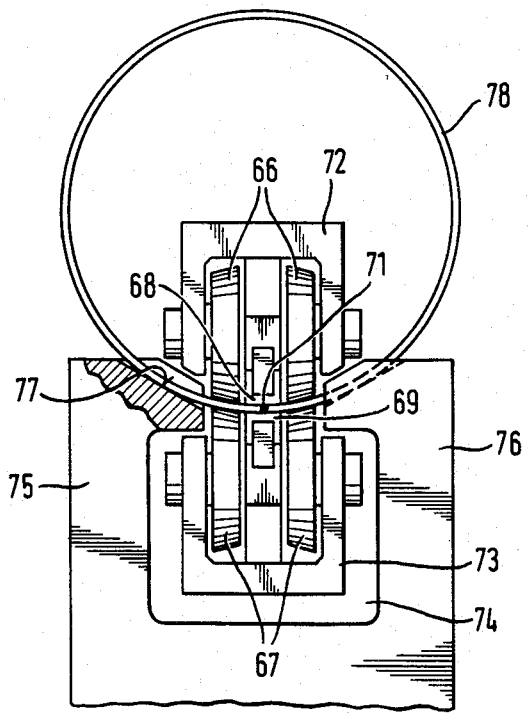
FIG. 4 is a side elevational view of a finishing station showing details of a tool slide and rim blank supports.

The arrangement of FIG. 4 shows finishing tool knives 68, 69 which move parallel to the longitudinal axis of the ring 78 for finishing the longitudinal joint 71. The knives are mounted in a jaw-like knife slide in two knife holders 72, 73. On opposite sides of each knife 68, 69 are arranged two guide rolls 66, 67 mounted for rotation or axes extending transverse to the longitudinal axis of the ring 78. The guide rolls 66, 67 engage opposite inner and outer surfaces of the ring 78 on opposite sides of the joint 71 so that the surfaces finished by the knives 68, 69 correspond approximately to the rounded configuration of the ring to be produced.

Upwardly open U-shaped supports 75, 76 are located on opposite sides of the guide rolls 66, 67 for holding the ring 78. An opening 74 is located between the supports 75, 76 in the zone of the joint 71. The opening 74 is also generally U-shaped between the supports 75, 76. The joint 71 is located in the middle of the opening 74 and is located at the lowest point of the ring 78. The ring 78 is held and clamped during finishing by the guide rolls 66, 67 which are arranged in pairs opposite from one another. The longitudinal forces developed during finishing are applied in the axial direction of the ring by the knives 68, 69 and by the rolls 66, 67, and such forces are taken through the ring 78 to the supports 75, 76. A centering effect for the ring 78 is achieved by having the bottom surfaces of the supports 75, 76 sloping downwardly toward the joint 71 as generally indicated at 77.

The elimination of complicated clamping devices and controls therefor at the finishing stations makes it more economical to manufacture the apparatus. In addition, rings can be formed at a higher speed because there is no need to wait until clamping jaws are closed and opened.

While there has been described what is at present considered to be the preferred embodiment of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. Apparatus for manufacturing cylindrical rings from flat strips of metal with each ring having a longitudinal axis and opposed ends welded together at a joint, said apparatus comprising: a plurality of work stations including a strip feed station, a ring forming station, a joint orientation station, a welding station for welding said joint and finishing stations for finishing said joint, said ring forming, joint orientation and welding stations being arranged in direct succession for processing a ring moving generally along said ring longitudinal axis through a first transfer path, said strip feed station being positioned for feeding strip to said ring forming station in a direction transverse to said ring longitudinal axis and said first transfer path, and said finishing stations being positioned for receiving rings moving thereto from said welding station in a second transfer path which is oriented transversely of said longitudinal axis of said ring and said first transfer path, said finishing stations having finishing tools working on said ring along a path transverse to said second transfer path and parallel to said axis each said ring has a predetermined width parallel to said longitudinal axis thereof, at least said finishing stations having finishing tools each movable parallel to said axis to finish the joint and stationary U-shaped support means comprising a pair of upwardly open generally U-shaped ring supports of a width approximately the same as said ring predetermined width, said pair of ring supports being respectively on opposite sides of the finishing tool and, said U-shaped ring member supports having web portions spaced apart to engage spaced apart peripheral portions of and center the cylindrical ring member and each said U-shaped ring member having upstanding rigid stationary legs to respectively engage opposite axial ends of the ring member to resist tool forces parallel to said axis.

2. The apparatus of claim 1 wherein said work stations in plan view are arranged in a generally Z-shaped configuration which includes end legs extending in opposite directions from opposite ends of a connecting leg, said strip feed station being positioned along one of said end legs and said finishing stations being positioned along the other of said end legs, and said ring forming, joint orientation and welding stations being positioned along said connecting leg, said Z-shaped configuration providing for efficient ring transport and easy access to each work station.

3. The apparatus of claim 1 including transfer means for transferring said rings from one station to another, and said transfer means between at least certain of said stations being operative to move said rings along a series of only longitudinally aligned smoothly and uniformly curved arcuate paths that are upwardly arched between adjacent ones of said certain stations for smooth and vibrationless ring transport.

4. The apparatus of claim 1 wherein said finishing station tools movable generally parallel to said ring axis for finishing said joint when said ring is positioned with said axis extending substantially horizontally and with said joint at the lowermost position of said ring, said U-shaped ring supports being positioned on opposite sides of each finishing tool for supporting said ring on opposite sides of said joint.

5. The apparatus of claim 4 including transfer means for transferring said rings from said welding station to said finishing stations and from one finishing station to another, and said transfer means being operative to move said rings in uniformly curved arcuate paths between stations to reduce transfer time so that said rings first move laterally upwardly and then laterally downwardly.

6. The apparatus of claim 5 wherein said transfer means includes gripper means for gripping an upper portion of said ring.

7. The apparatus of claim 1 wherein at least one of said finishing stations includes slide means movable generally parallel to said ring axis and carrying finishing tools for finishing said joint, said slide means including guide rollers engageable with inner and outer surfaces of said ring on opposite sides of said joint, and a pair of upwardly open generally U-shaped ring supports on opposite sides of said slide means and closely adjacent thereto.

8. The apparatus of claim 1 wherein said welding station includes a welding machine having clamping jaws which are movable along the axial direction of said ring, said clamping jaws when retracted allowing a transport of said ring along a path transverse to said ring axis from said welding station to said finishing stations.

9. Apparatus for finishing a welded joint in a cylindrical ring member having a longitudinal axis and a welded joint extending generally parallel to said axis, said apparatus comprising:

a tool slide movable generally parallel to said ring longitudinal axis and carrying finishing tools for finishing said joint, said slide including guide rolls engageable with inner and outer surfaces of said ring member on opposite sides of said joint; and, a pair of upwardly open generally U-shaped stationary ring member supports, each ring member support positioned on an opposite side of said slide and closely adjacent thereto, said ring member having a predetermined width parallel to said ring longitudinal axis and said ring member supports having a width approximately the same as said ring predetermined width, said U-shaped ring member supports having web portions spaced apart to engage spaced apart peripheral portions of and center the cylindrical ring member and each said U-shaped ring member having upstanding rigid stationary legs to respectively engage opposite axial ends of the ring member to resist tool forces parallel to said axis.

10. The apparatus of claim 9, further including a strip feed station, a ring forming station, a joint orientation station, a welding station and at least two joint finishing stations, first transfer means for moving said ring generally along said ring axis between said ring forming, joint orientation and welding stations, second transfer means for moving said ring in a first direction transversely of said ring axis from said welding station to said at least two finishing stations and between said finishing stations and wherein said strip feed station feeds said flat metal strip to said ring forming station in a second direction transversely of said ring longitudinal axis; and each of said joint finishing stations having said tool slide, finishing tools and pair of U-shaped stationary ring member supports.

11. The apparatus of claim 10 wherein during movement of said ring transverse to said ring axis said second transfer means moves said ring in smoothly and uniformly curved arcuate paths that are upwardly arched for high acceleration to reduce transfer time between stations.

12. The apparatus of claim 9 wherein said support webs have bottom surfaces which slope downwardly toward one another to facilitate centering of the ring members.

* * * * *